US011214435B2

(12) United States Patent
Monti

(10) Patent No.: US 11,214,435 B2
(45) Date of Patent: Jan. 4, 2022

(54) METHOD FOR FASTENING A TAG TO A CONNECTING THREAD TO A FILTER BAG FOR INFUSION PRODUCTS, A TAG-THREAD ASSEMBLY FOR A FILTER BAG AND A METHOD FOR FIXING THE TAG TO A CONNECTING THREAD WITH A FILTER BAG

(71) Applicant: REVISIONI INDUSTRIALI S.r.l., Ozzano Emilia (IT)

(72) Inventor: Giuseppe Monti, Pianoro (IT)

(73) Assignee: I.M.A. INDUSTRIA MACCHINE AUTOMATICHE S.P.A., Ozzano Emilia (IT)

( * ) Notice: Subject to any disclaimer, the term of this patent is extended or adjusted under 35 U.S.C. 154(b) by 881 days.

(21) Appl. No.: 15/501,072

(22) PCT Filed: Jul. 24, 2015

(86) PCT No.: PCT/IB2015/055629
§ 371 (c)(1),
(2) Date: Feb. 1, 2017

(87) PCT Pub. No.: WO2016/024178
PCT Pub. Date: Feb. 18, 2016

(65) Prior Publication Data

US 2017/0253424 A1 Sep. 7, 2017

(30) Foreign Application Priority Data

Aug. 14, 2014 (IT) ..... BO2014A000463

(51) Int. Cl.
*B65D 85/808* (2006.01)
*B65D 85/812* (2006.01)
(Continued)

(52) U.S. Cl.
CPC ..... *B65D 85/812* (2013.01); *B65B 29/04* (2013.01); *B65B 29/02* (2013.01); *B65D 85/70* (2013.01); *B65D 85/804* (2013.01); *B65D 85/808* (2013.01)

(58) Field of Classification Search
CPC ..... B65B 29/02; B65B 29/04; B65B 29/028; B65B 51/146; B65B 85/804; B65D 85/70;
(Continued)

(56) References Cited

U.S. PATENT DOCUMENTS 1,458,445 A * 6/1923 Scott ..... G09F 3/14 40/662
2,791,505 A 5/1957 Barnett
(Continued)

FOREIGN PATENT DOCUMENTS

DE 102 26 383 A1 12/2002
DE 20 2006 007017 U1 8/2006
(Continued)

OTHER PUBLICATIONS

EP 0788981.*
KR-101022889-B1, Abstract, English tranlation, Mar. 2011 (Year: 2011).*

*Primary Examiner* — Hong T Yoo
(74) *Attorney, Agent, or Firm* — R. Neil Sudol; Henry D. Coleman

(57) ABSTRACT

A tag to be fixed to a connecting thread to a filter bag for infusion products has a flat body delimited by a perimeter edge; a first slit, starting from a first point of a side of the perimeter edge; a second slit and a third slit, starting from respective points of such side of the perimeter edge arranged on opposite sides with respect to the first starting point of the first slit. At least one of the second and third slits exhibits, starting from the respective starting point on said side, a
(Continued)

progression and a development directed towards a point of a straight line in the plane of the body of the tag and perpendicular to said side at the first starting point of the first slit; the first slit, the second slit and the third slit being such as to enable passage there-through of a connecting thread, for fixing the tag to the thread.

16 Claims, 8 Drawing Sheets

(51) Int. Cl.

| | |
|---|---|
| ***B65B 29/04*** | (2006.01) |
| *B65B 29/02* | (2006.01) |
| *B65D 85/00* | (2006.01) |
| *B65D 85/804* | (2006.01) |

(58) Field of Classification Search
CPC ... B65D 85/804; B65D 85/808; B65D 85/812
See application file for complete search history.

(56) References Cited

U.S. PATENT DOCUMENTS

| | | | | | |
|---|---|---|---|---|---|
| 4,869,007 | A * | 9/1989 | Fast | G09F 1/10 | 40/664 |
| 5,379,538 | A * | 1/1995 | Osborne | G09F 3/10 | 156/227 |
| 5,797,243 | A * | 8/1998 | Tagliaferri | B65D 85/812 | 206/5 |

FOREIGN PATENT DOCUMENTS

| | | | | |
|---|---|---|---|---|
| DE | 10 2011 053589 | A1 | 3/2013 | |
| KR | 101022889 | B1 * | 3/2011 | B65D 85/812 |

* cited by examiner

E
R
P
C
L
F1
F2
F3
P1
P2
P3
Z
S
T

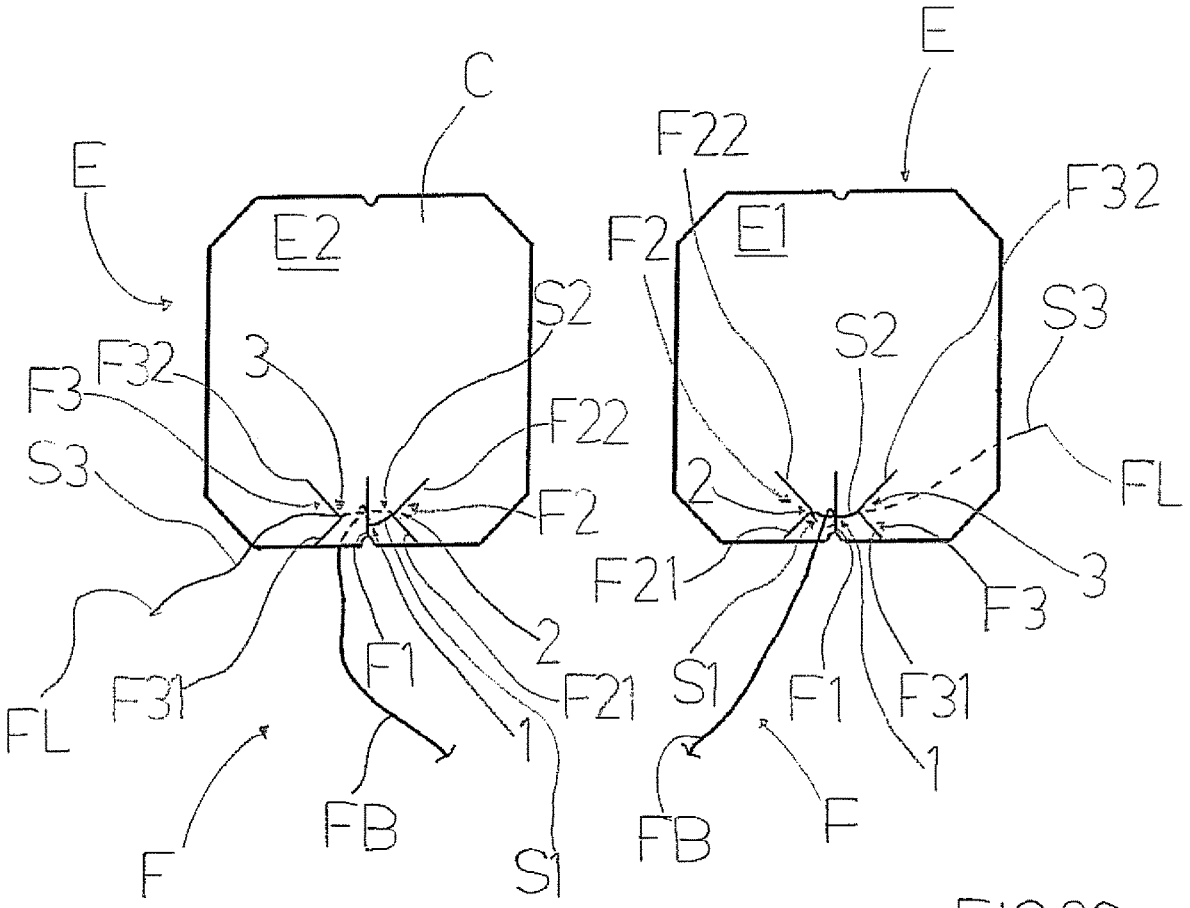
FIG 3C
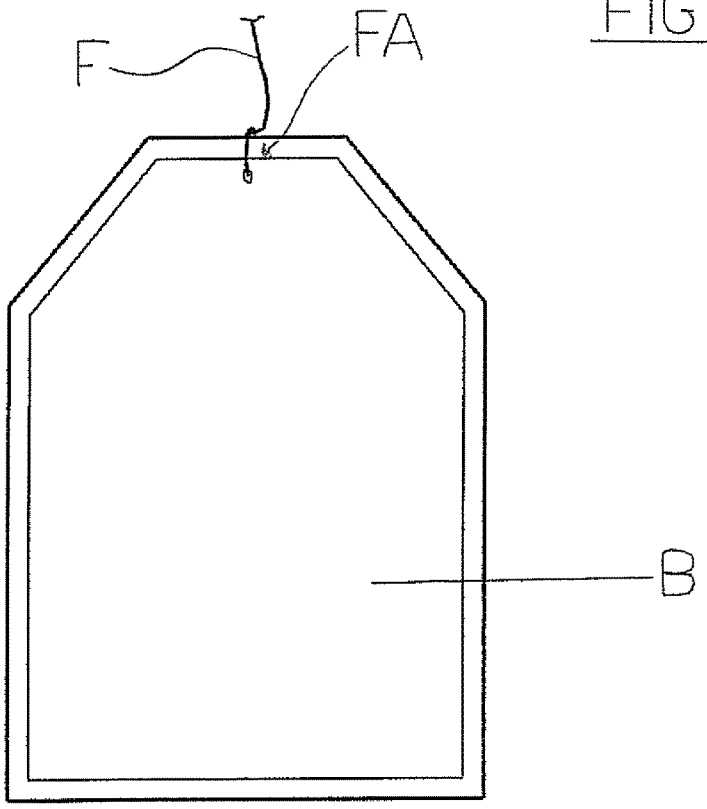

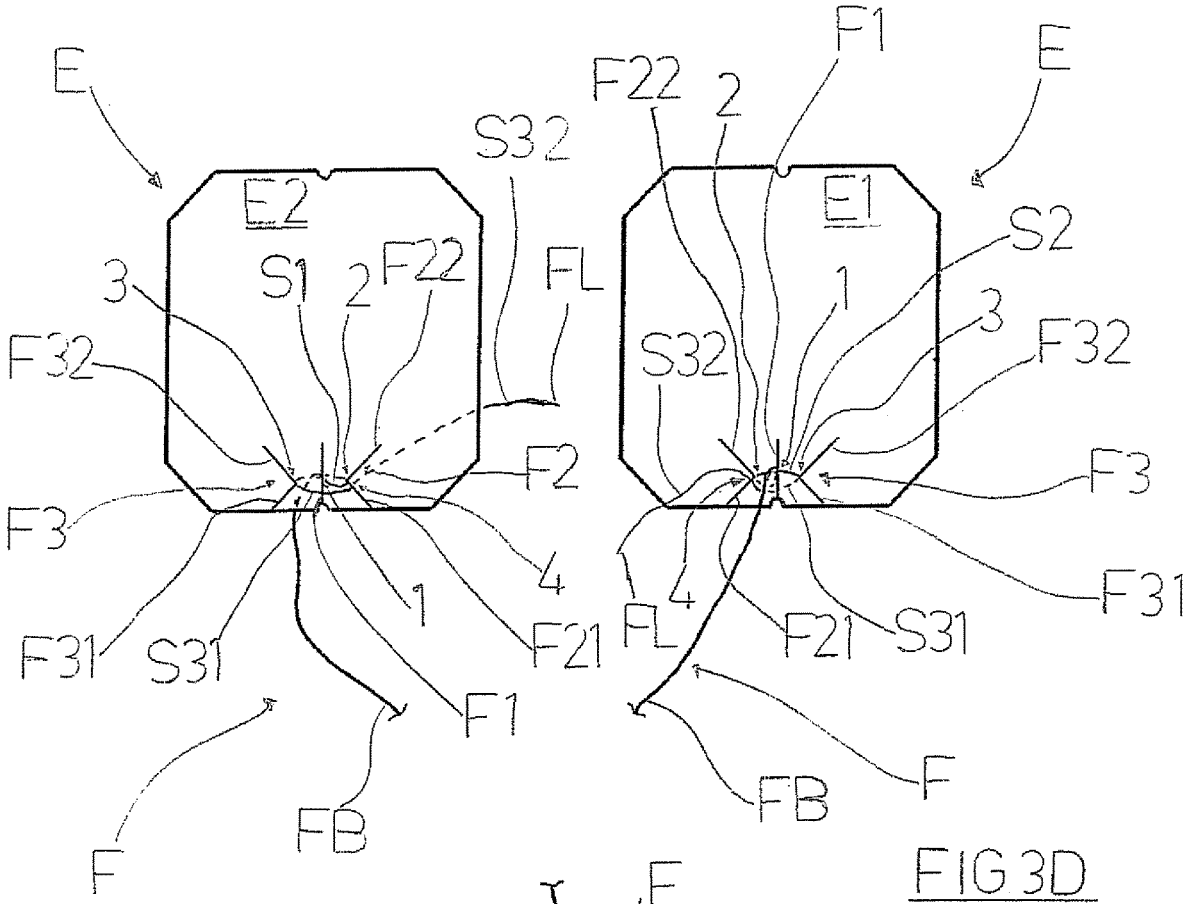
FIG 3D
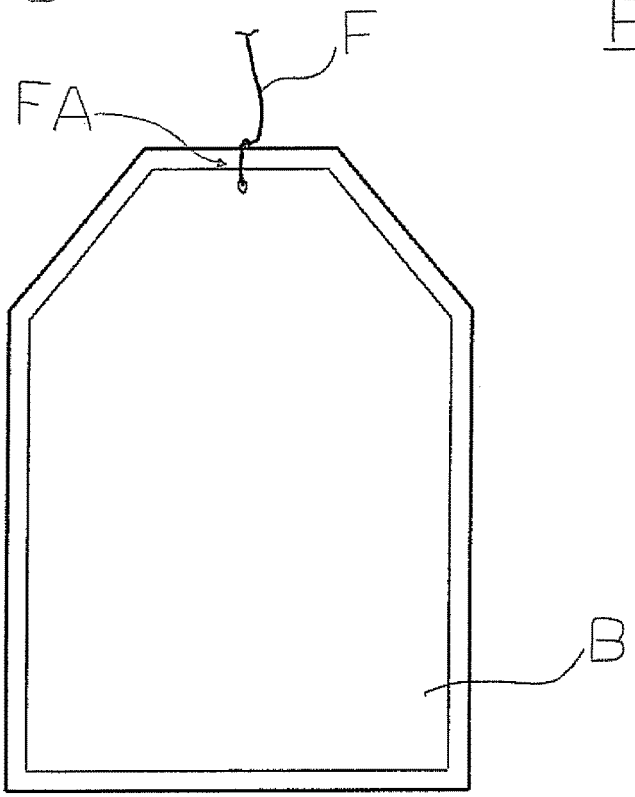

METHOD FOR FASTENING A TAG TO A CONNECTING THREAD TO A FILTER BAG FOR INFUSION PRODUCTS, A TAG-THREAD ASSEMBLY FOR A FILTER BAG AND A METHOD FOR FIXING THE TAG TO A CONNECTING THREAD WITH A FILTER BAG

FIELD OF THE INVENTION

The present invention relates to the technical sector concerning filter bags for infusion products (such as for example tea, camomile, etc.) and automatic packaging thereof.

DESCRIPTION OF THE PRIOR ART

Once an infusion product has been packaged in a relative filter bag, it is usual for it to be closed and sealed and to associate, by means of a cotton thread, a tag to the bag.

The tag not only bears, possibly, an image and/or a logo representing the manufacture of the infusion product or other information or images, but also has a practical function as the consumer holds the tag between her or his fingers and can immerse the bag into the hot water and then extract it thanks to the presence of the thread which connects the tag to the bag.

Tags are known which comprise at least a through-hole; in particular tags are known (N), such as the one illustrated in FIG. 1, which comprise two through-holes (N1, N2) made in proximity of a side of the perimeter edge thereof and which are used to fix the tag (N) to a cotton thread connecting to the filter bag (B).

For example, to fix the tag (N) to the thread (M), a present method consists in first threading a free end of the thread (M) (the other end of the thread is the one coupling to the bag (B)) via a first hole (N1) of the two holes (N1, N2), passing it from a first face to the second face of the tag (N), then passing the same end through the second hole (N2), from the second face newly to the first face of the tag (N), then folding the portion of thread (M) projecting from the first face to realise a slot and passing, through this slot, the end of the thread (M), pulling it up to creating a knot (see for example the steps illustrated in FIGS. 1A, 1B and 1C).

Also known are other and different ways for passing the thread through the two holes so as to realise a knot which can fix and block the tag to the thread.

In any case, at present in order to realise the connection and fixing of the tag to the thread a knot is made on the thread which enables keeping the tag blocked to the thread, whether a simple knot, such as the one illustrated in FIG. 1C, or a different type of knot.

To pass the thread through the holes present on the known tags and to fold it so as to make the knot (whether a simple or more complex knot), apparatus are used which include the use of a needle having a particular form and structure which must both retain and move the thread, passing it through the holes present on the tag, in quite complex patterns: the needle is in any case expensive, and the repeated and continuous work cycles the needle is subjected to are risky for its integrity, incurring the possibility of having to replace it.

Other known apparatus use a series of aspirating elements which, via a special combination of aspirating actions, determine passage of the thread through the holes and its folding to make the knot on the tag: however the aspirating action also causes suction of dust into the aspirating elements which consequently require frequent maintenance and/or replacement.

SUMMARY OF THE INVENTION

The aim of the present invention is therefore to provide a method for fastening a tag to a connecting thread to a filter bag for infusion products which does not incur the drawbacks described above.

In particular, an aim of the present invention is to provide a new tag having a shape and characteristics such as not to require making a knot in the thread in order to fix the tag to the thread.

The aim is obtained with a tag according to claim 1.

Other advantageous characteristics of the tag disclosed by the invention are set down in the claims dependent on claim 1.

A further aim of the present invention is to provide a tag-thread assembly for a filter bag, according to the contents of claim 8.

Lastly, a further aim of the present invention is also to disclose a method for fixing the tag of the invention to a connecting thread with a filter bag, according to claim 10, without making any knot in the thread.

BRIEF DESCRIPTION OF THE DRAWINGS

The characteristics of preferred embodiments of the tag of the present invention, of a preferred embodiment of tag-thread assembly for a filter bag of the invention and a preferred order of work steps for fixing the tag to a thread proposed by the invention will be described in the following with reference to the appended tables of drawings, in which:

FIG. 1, already mentioned in the foregoing, illustrates a tag (N) according to the prior art, which is to be fixed to a thread (M) connecting with a filter bag (B), while FIGS. 1A, 1B and 1C illustrate a possible sequence of actions carried out according to a prior art method for fixing the tag (B) to the thread (M) by making a knot on the thread, once it has been passed through the two holes (N1, N2) present on the tag (N);

Figures 1, 1A, 1B, 1C:
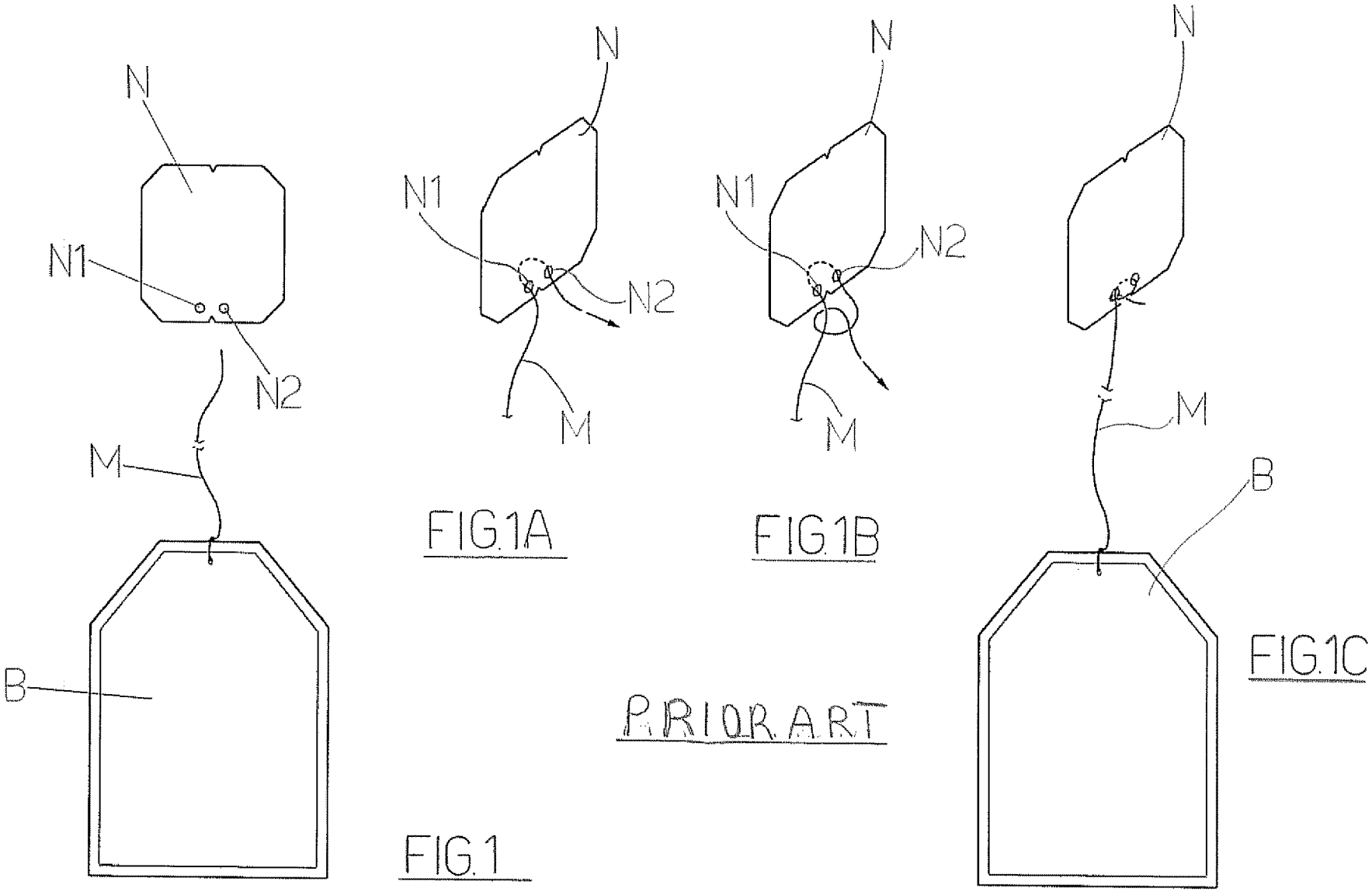
FIG.1C PRIOR ART
Figures 2A, 2B, 2C, 2D, 2E, 2F, 2G, 2H:
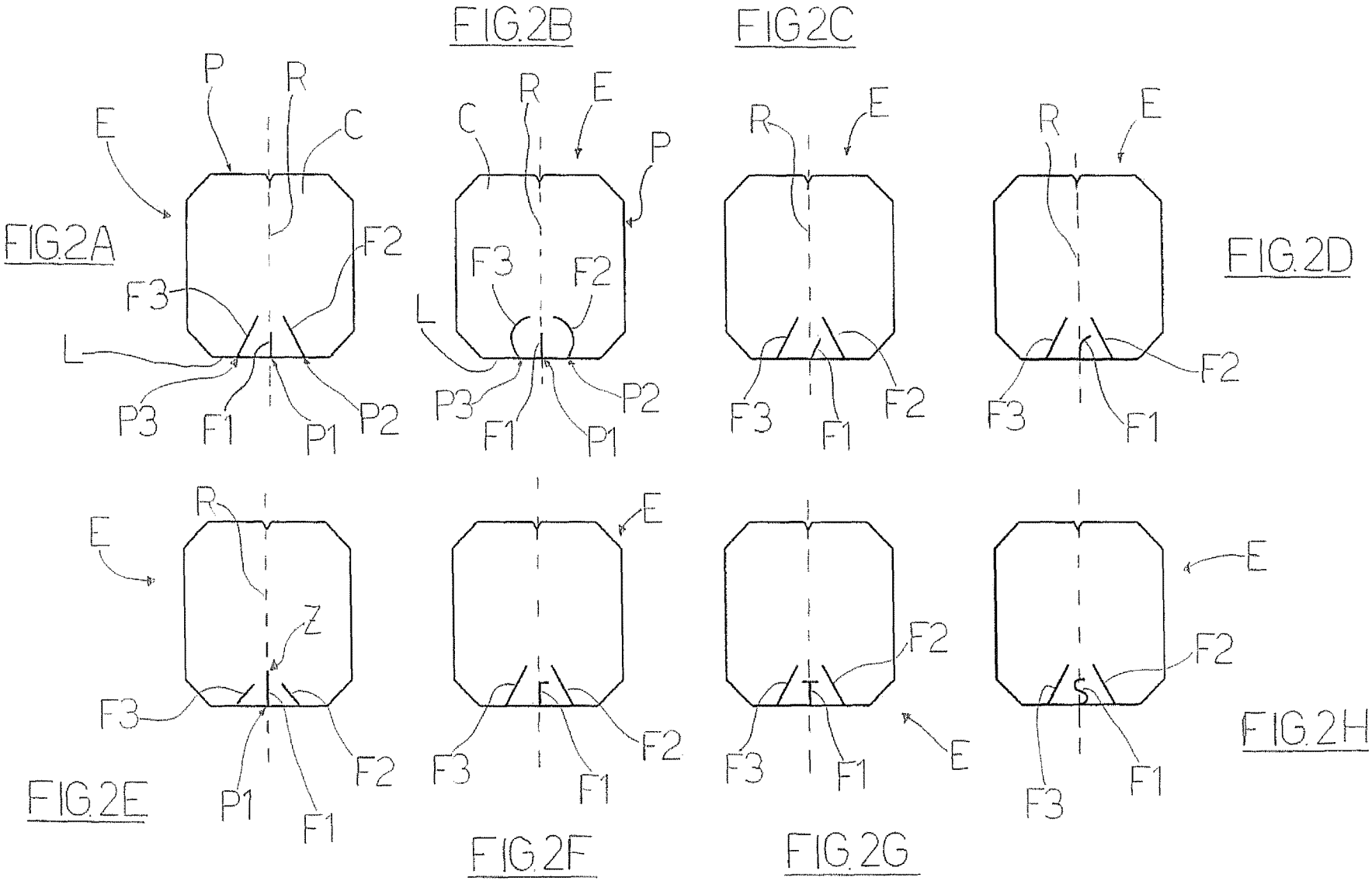
Figure 2L:
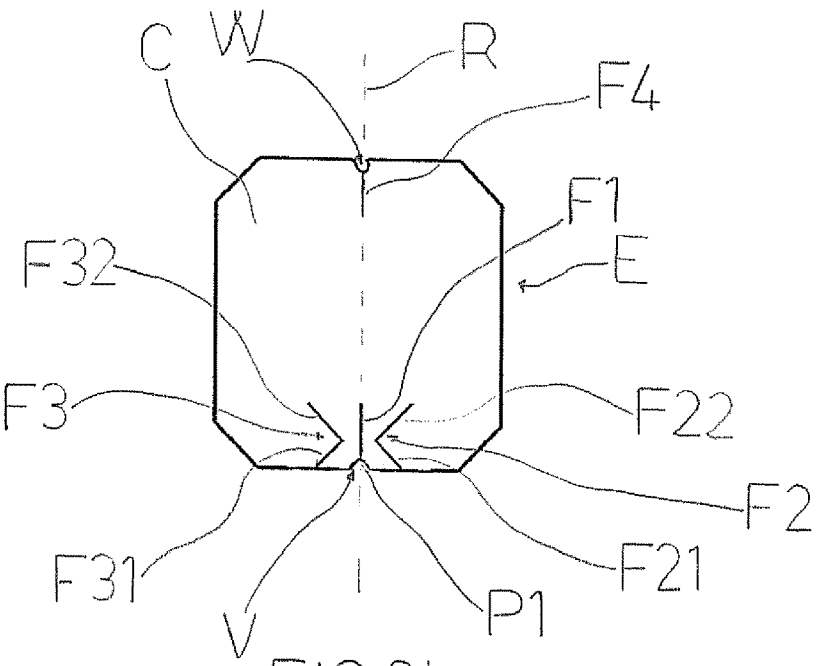
Figure 3A:
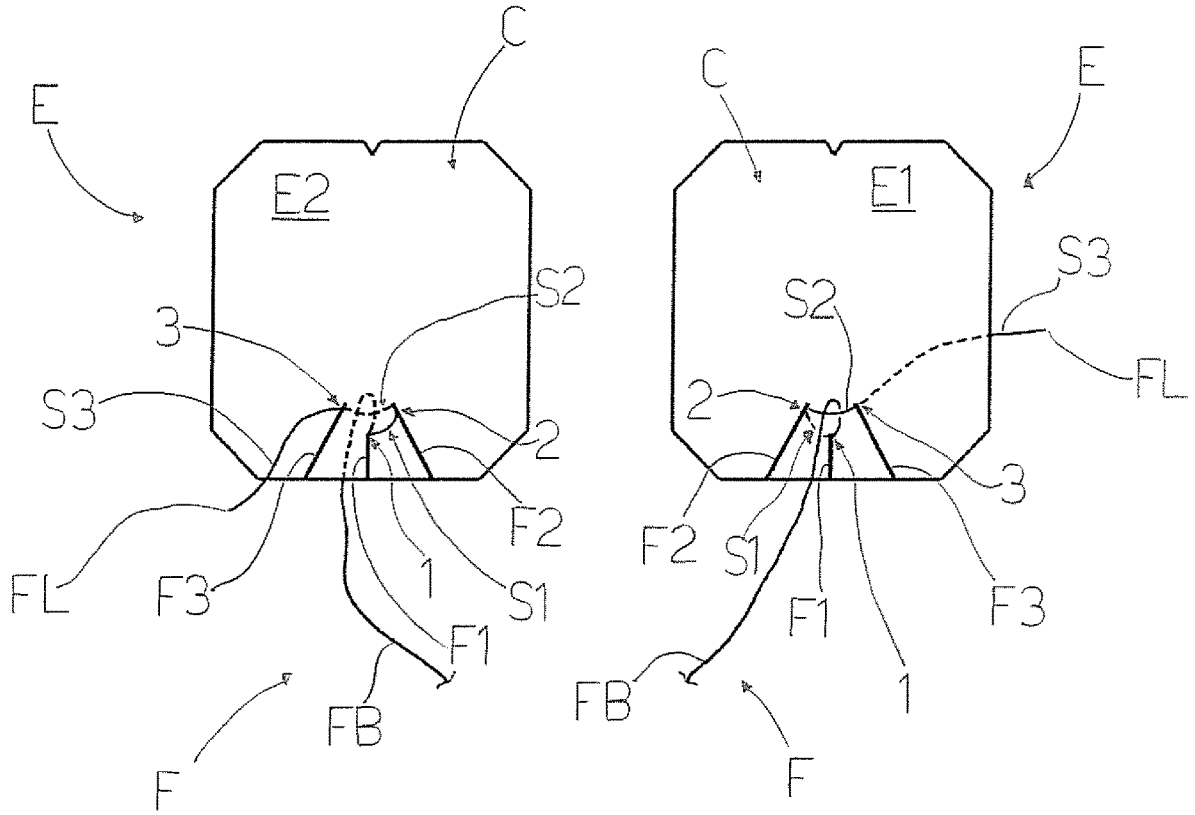
Figure 3A:
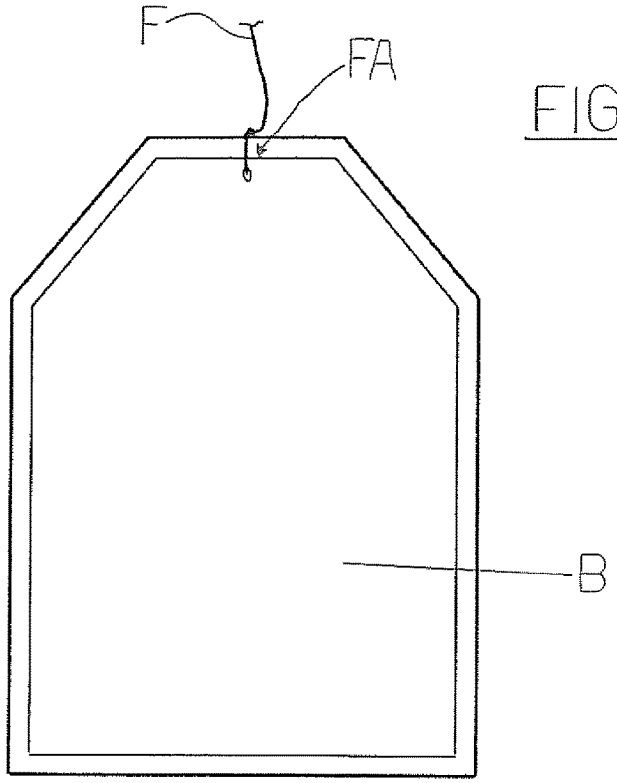
Figure 3B:
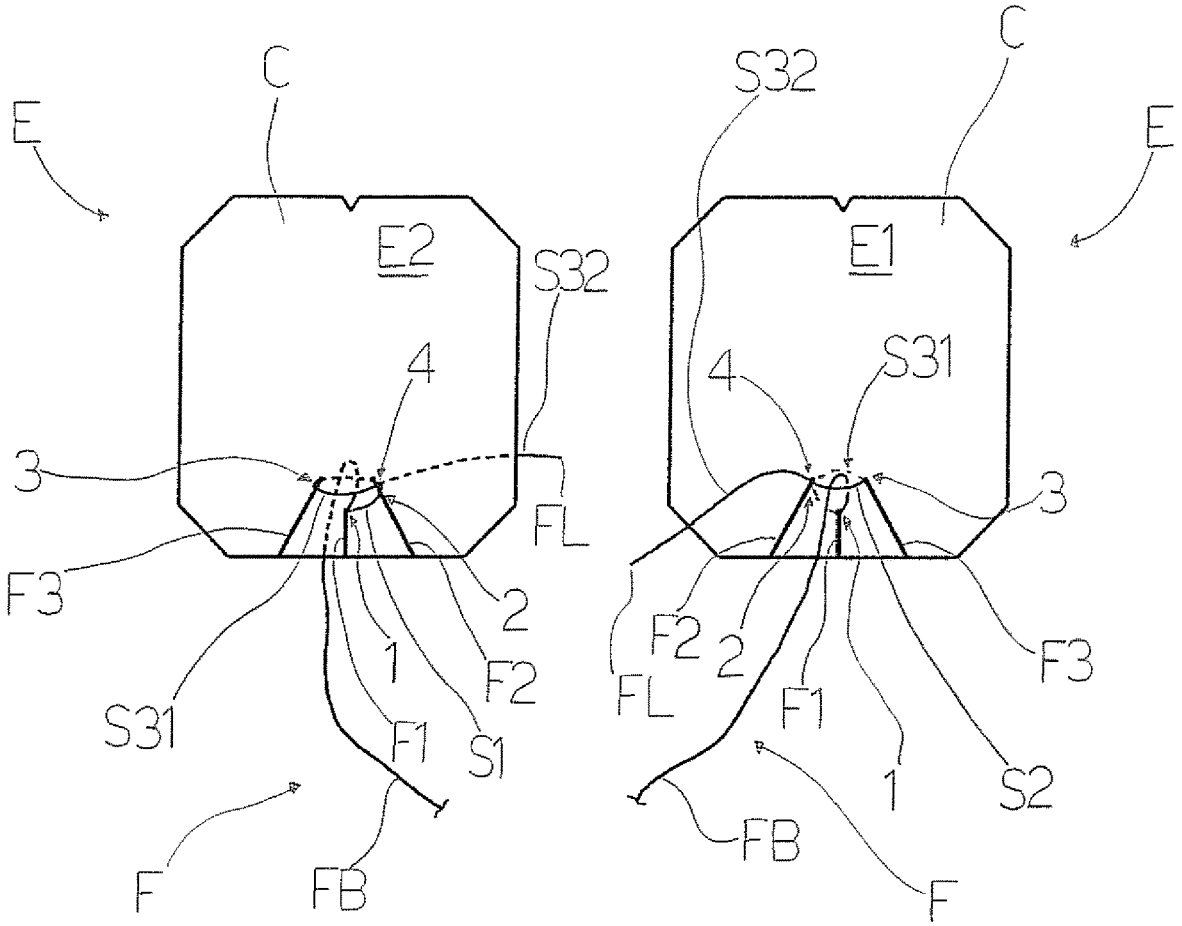
Figure 3B:
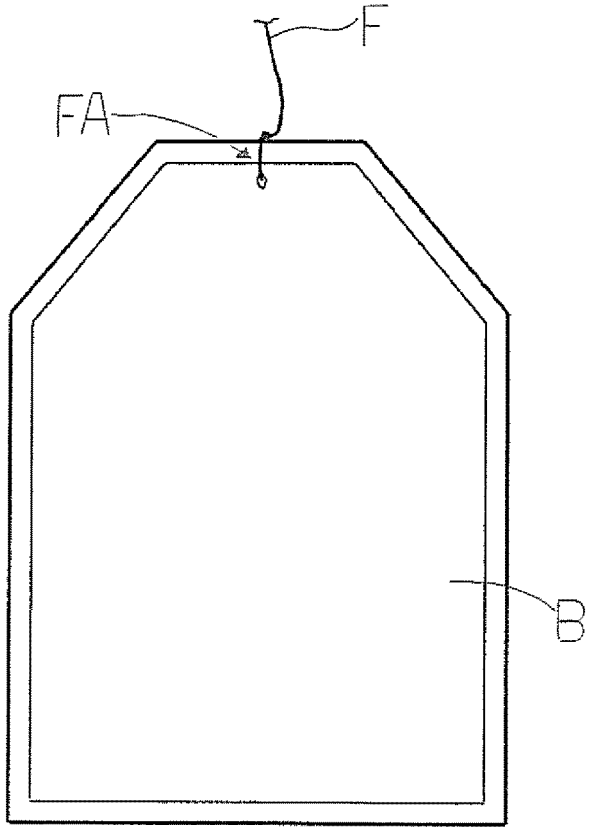
Figure 4E:
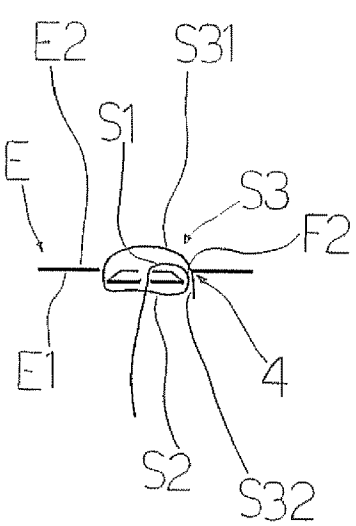
Figure 4D:
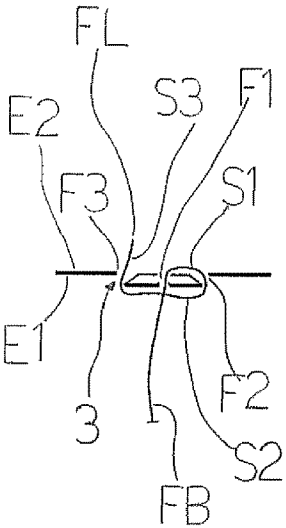
Figure 4C:
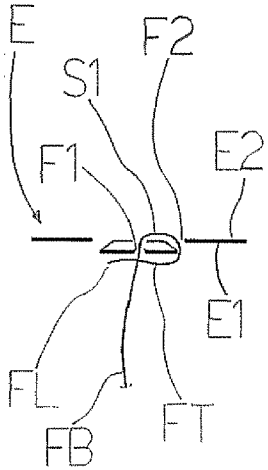
Figure 4B:
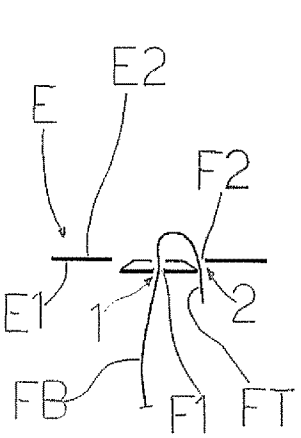
Figure 4A:
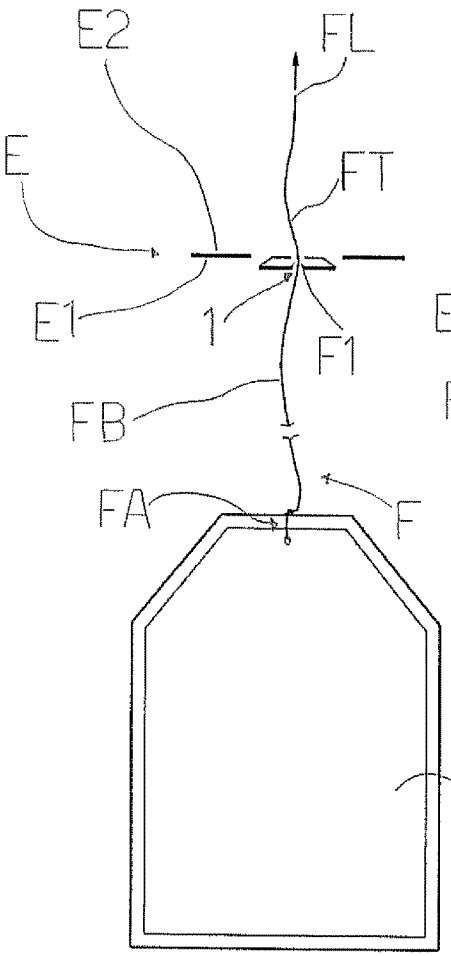

figures from 2A to 2L illustrate second relative frontal views of possible embodiments of a tag according to the present invention;

FIG. 3A is a front view of a tag-thread assembly for a filter bag disclosed by the present invention, according to a possible embodiment; in this figure for greater clarity, both faces of the tag are illustrated at the same time in a front view, with the thread attached to it; in this figure the connection of the thread to the filter bag has been illustrated purely by way of example;

FIG. 3B is a front view of a tag-thread assembly for a filter bag disclosed by the present invention, according to a further possible embodiment; in this figure as in FIG. 3A for greater clarity, both faces of the tag are illustrated at the same time in a front view, with the thread attached to it; in this figure the connection of the thread to the filter bag has been illustrated purely by way of example;

FIG. 3C is a front view of a tag-thread assembly for a filter bag disclosed by the present invention, where there is a tag according to the possible embodiment, shown in FIG. 2L; in this figure for greater clarity, both faces of the tag are illustrated at the same time in a front view, with the thread attached to it; in this figure the connection of the thread to the filter bag has been illustrated purely by way of example;

FIG. 3D is a front view of a tag-thread assembly for a filter bag disclosed by the present invention, where there is a tag according to the possible embodiment, shown in FIG. 2L; in this figure, as in FIG. 3C, for greater clarity, both faces of the tag are illustrated at the same time in a front view, with the thread attached to it; the connection of the thread to the filter bag has been illustrated purely by way of example;

figures from 4A to 4D illustrate a sequence of significant steps of the method of the invention, for fixing the tag to a connecting thread with a filter bag; in these figures the tag is shown arranged perpendicular to the plane of the sheet, and in FIG. 4A the connection of the thread to the filter bag has been illustrated purely by way of example;

FIG. 4E illustrates a further step of the method of the invention; in this figure too the tag is shown arranged perpendicular to the plane of the sheet.

DESCRIPTION OF THE PREFERRED EMBODIMENTS

With reference to the figures, reference letter (E) denotes a tag (E) to be fixed to a connecting thread (F) to a filter bag (B) for infusion products of the present invention.

As illustrated for example in figures from 2A to 2L, the tag (E) comprises a flat body (C) which is delimited by a perimeter edge (P).

In the appended figures the tag (E) has been illustrated in an irregular octagonal shape (i.e. not with all-equal sides); that is, it is square/rectangular with the edges rounded; this does not exclude the possibility that the invention can include other types of shape, for example polygonal such as a square, rectangular, hexagonal and so on, or even circular or elliptical.

The special characteristics of the tag (E) disclosed by the present invention consist in the fact that it comprises:

- a first slit (F1), which starts from a first point (P1) of a side (L) of the perimeter edge (P);
- a second slit (F2) and a third slit (F3), starting from respective points (P2, P3) of the same side (L) of the perimeter edge (P) arranged on opposite sides with respect to the first starting point (P1) of the first slit (F1), In particular, a further special characteristics of the tag (E) consists in the fact that at least one of the second slit (F2) and the third slit (F3) exhibiting, starting from the respective starting point (P2, P3) on said side (L), a progression and a development directed towards a point of a straight line (R) (illustrated in a broken line in the figures) comprised in the plane of the body (C) of the tag (E) and perpendicular to said side (L) at the first starting point (P1) of the first slit (F1).

As for example illustrated in the preferred embodiments of figures from 2A to 2H, the tag (E) is preferably such that both the second slit (F2) and the third slit (F3) exhibit a progression and a development directed towards a same point of the part of the straight line (R) comprised in the plane of the body (C) of the tag (E) and perpendicular to the side (L) at the first starting point (P1) of the first slit (F1).

The terms progression and development it is meant that the final part of the second (F2) and/or third slit (F3) identifies a direction a prolongation of which is such as to intersect, at a point thereof, the portion of straight line (R) comprised in the plate of the body (C) of the tag (E) and perpendicular to the side (L) at the first starting point (P1) of the first slit (F1).

The first slit (F1), the second slit (F2) and the third slit (F3) are such as to enable passage there-through from one side of the tag (E) to another (i.e. from a first face to a second face thereof, and vice versa) of a connecting thread (F) to a filter bag (B) for infusion products, for fixing the tag (E) to the thread (F).

The following part of the present description will include a description of the ways in which the thread (F) can pass through the tag (E) from one face to the other, through the first slit (F1), second slit (F2) and third slit (F3), to fix the tag (E) to the thread (F), without requiring making a knot: this is possible thanks to the presence of the three slits and the fact that at least a slit, from the second (F2) and third (F3) (in particular both as illustrated in the figures) exhibits, starting from the respective starting point (P2, P3) on the side (L), a progression and a development directed towards a point of the straight line (R) comprised in the plane of the body (C) of the tag (E) and perpendicular to the side (L) at the first starting point (P1) of the first slit (F1).

This enables having at least a slit (second slit (F2) or third slit (F3), or in particular both) by the side of the first slit (F1), which has a development or extension that is divergent from a point inside the body (C) of the tag (E) towards the side (i.e. towards the outside): with this characteristic the tag is able to provide an action of resistance to unthreading of the thread (F) crossing the second/third slit (F2, F3) and to make the fixing of the thread (F) to the tag (E) stable (see also the following).

Other characteristics of the tag (E) of the present invention are as follows.

The tag (E) is such that the flat body (C) exhibits a shape that is such as to have at least an axis of symmetry (R) while the first starting point (P1) of the first slit (F1) on the side (L) of the perimeter edge (P) is arranged at the axis of symmetry (R) (in this case the axis of symmetry coincides with the above-mentioned straight line (R)), and at least one of the second slit (F2) and the third slit (F3) exhibits, starting from the relative starting point (P2, P3) on the side (L), a progression and a development converging towards a point of said at least an axis of symmetry (R) and comprised in the body (C) of the tag (E).

Preferably, as illustrated in figures from 2A to 2H, both the second slit (F2) and the third slit (F3) exhibit, starting from the relative starting point (P2, P3) on the side (L), an extension and a development converging towards a point of said at least an axis of symmetry and comprised in the body (C) of the tag (E).

At least one from between the second slit (F2) and the third slit (F3) exhibits a straight extension (see FIG. 2A and from FIG. 2C to FIG. 2H) or a curved extension (see FIG. 2B).

The tag (E) can be such that the first slit (F1) exhibits a straight development perpendicular to the side (L) of the perimeter edge (P) (FIGS. 2A, 2B and 2E) either inclined (FIG. 2C) with respect to said side (L), or a curved development (FIG. 2D).

Further, the first slit (F1) can also exhibit an extension such as to assume one of the following shapes: T, L or S (see figures from 2E to 2G).

In other embodiments that are not illustrated, the tag (E) can be such that the shape or extension of the first slit (F1), the second slit (F2) and the third slit (F3) are different to the ones described above and illustrated in the figures, while still falling within the scope of the present invention.

As illustrated in the figures, the tag (E) can be such that the extension of the first slit (F1) is smaller than the extension of the second slit (F2) and the third slit (F3).

In a possible embodiment, particularly advantageous and illustrated in FIG. 2E, the tag (E) is such that the first slit (F1), the second slit (F2) and the third slit (F3) exhibit a straight development, the extension of the first slit (F1) being at least equal, in particular larger, than the extension of the second slit (F2) and the third slit (F3), and in that both the second slit (F2) and the third slit (F3) exhibit an inclination with respect to the side (L) that is such that both exhibit a converging direction towards the final end point (Z) of the first slit (F1).

Figure 2I:
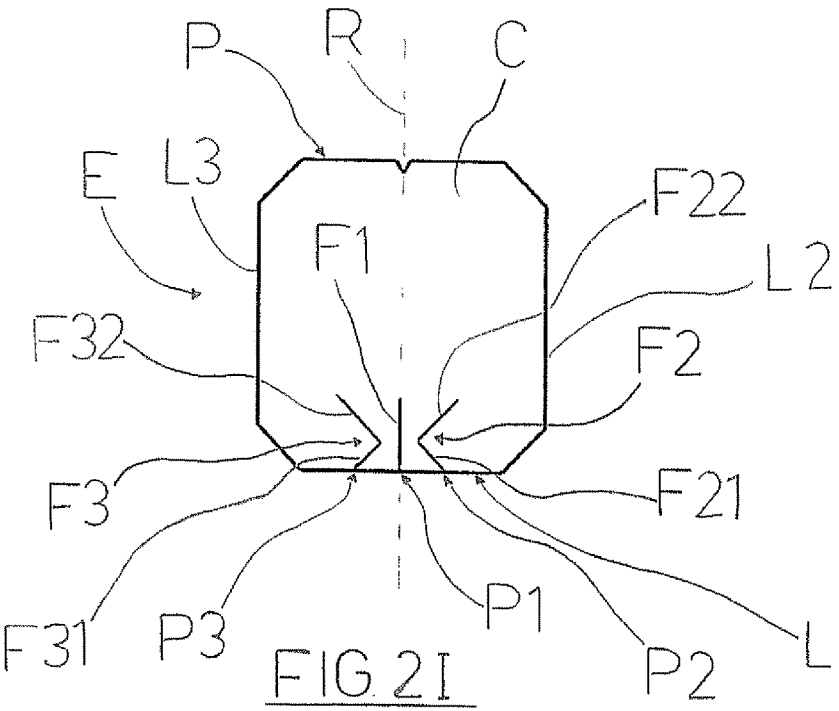

FIGS. 2I and 2L illustrate two possible embodiments of the tag (E) according to the invention, on the basis of which the second slit (F2) and the third slit (F3) exhibit a particular conformation and form, each comprising two consecutive straight lines in different directions, which form between them an acute or at most straight angle, with the edge facing towards the first slit (F1), i.e. as two consecutive segments of a portion of a zig-zag line.

In particular, the second slit (F2) exhibits, starting from the respective starting point (P2) on the side (L) of the perimeter edge (P), from which side (L) the first slit (F1) and the third slit (F3) also originate, a first straight part (F21) which exhibits a direction directed towards and converging towards a point of the part of the straight line (R) (illustrated in a broken line in FIGS. 2I and 2L) comprised in the plane of the body (C) of the tag (E) and perpendicular to the side (L) at the first starting point (2I) of the first slit (F1), and a second straight part (F22) consecutive and continuous to the first straight part (F21) which instead exhibits a direction directed towards a second side (L2) of the perimeter edge (P) of the tag (i.e. divergent from the straight line (R).

In this way the first straight part (F21) and the second straight part (F22) of the second slit (F2) form an edge facing towards the straight line (R) and in particular towards the first slit (F1), and between them form an acute angle or at most a right-angle, in particular facing towards the second side (L2).

In particular, the third slit (F3) exhibits a corresponding shape: starting from the respective starting point (P3) on the side (L) of the perimeter edge (P), (from which side (L) the first slit (F1) and the second slit (F2) also originate), a first straight part (F31) which exhibits a direction directed towards and converging towards a point of the part of the straight line (R) (illustrated in a broken line in FIGS. 2I and 2L) comprised in the plane of the body (C) of the tag (E) and perpendicular to the side (L) at the first starting point (P1) of the first slit (F1), and a second straight part (F32) consecutive and continuous to the first straight part (F31) which instead exhibits a direction directed towards a third side (L3) of the perimeter edge (P) of the tag (E) (i.e. divergent from the straight line (R)).

In this way the first straight part (F31) too and the second straight part (F32) of the third slit (F3) form an edge facing towards the straight line (R) and in particular towards the first slit (F1), and between them form an acute angle or at most a right-angle, in particular facing towards the third side (L3).

These particular conformations of the second slit (F2) and third slit (F3) enable having a more effective fixing of the thread to the tag, as will be described in greater detail, as well as making the operations of passage and insertion of the thread easier from a face to another of the tag through the second slit (F2) and third slit (F3).

This is because, during a specific coupling step of the thread to the tag, as will be better described in the following, these particular shapes of the second slit (F2) and the third slit (F3) enable realising a relative movement between, on the one side, the parts of the tag comprised between the second slit (F2) and the second side (L2) of the perimeter edge (P) adjacent thereto and between the third slit (F3) and the third side (L3) of the perimeter edge (P) adjacent thereto, and on the other side the part of the tag comprised between the second slit (F2) and the third slit (F3) containing the first slit (F1).

In this way, a sufficient manoeuvring space is created for moving the thread and facilitating passage thereof through the second and third slits, for achieving the coupling of the thread to the tag following the steps of the method which will be described in greater detail in the following.

In greater detail, as illustrated in FIGS. 2I and 2L, the first straight part (F21) of the second slit (F2) and the first straight part (F31) of the third slit (F3) exhibit directions such that a prolongation thereof is such as to intersect the part of the straight line (R) comprised in the plane of the body (C) of the tag (E), and perpendicular to the side (L) at the starting point (P1) of the first slit (F1), in a same corresponding point, i.e. the first straight part (F21) of the second slit (F2) and the first straight part (F31) of the third slit (F3) exhibit a same inclination with respect to the side (L) of the perimeter edge (P) from which they originate, i.e. they form an angle of a same value with the side (L).

In greater detail, and again with reference to the embodiments illustrated in FIGS. 2I and 2L, the second straight part (F22) of the second slit (F2) and the second straight part (F32) of the third slit (F3) exhibit directions such as to form, with the relative first straight parts (F21, F31) an angle of a same value.

In a further aspect of these two embodiments, the length of the first slit (F1), the length of the first straight part (F21) of the second slit (F2) and the length of the second straight part (F22) of the second slit (F2), as well as the length of the first straight part (F31) and the length of the second straight part of the third slit are such that the end point of the second straight part (F22) of the second slit (F2), the end point of the first slit (F1) and the end point of the second straight part (F32) of the third slit (F3) are all at a same distance from the side (L) from which the first (F1), second (F2) and third (F3) slit originate.

The tag (E) of these two particular embodiments illustrated in FIGS. 2I and 2L are such that the relative flat body (C) exhibits a shape such as to have at least an axis of symmetry (R) and in that the first starting point (P1) of the first slit (F1) on the side (L) of the perimeter edge (P) is arranged at the axis of symmetry (R), the first slit (F1) exhibiting a straight shape arranged at the axis of symmetry (R).

In this case the first straight part (F21) of the second slit (F2) and the first straight part (F31) of the third slit (F3) exhibit directions such that the prolongation thereof is such as to intersect the first straight slit (F1) at a same corresponding point.

FIG. 2L illustrates a tag (E) according to the invention having further particular and advantageous aspects.

It comprises, at the first starting point (P1) of the first slit (F1), a first semi-circular cut (V), and at the point of the opposite side to the side (L) situated on the axis of symmetry (R), a second semi-circular cut (W).

The presence of these two cuts (V, W) facilitates the positioning of the thread about the tag, once it has been coupled and fixed (in the ways described in the following) to the tag.

Further, the tag (E) can include a fourth slit (F4) starting from this point on the side opposite the side (L) from which the other three slits originate, having a straight shape and arranged at the axis of symmetry (R): this fourth slit (F4) can be used as a further coupling/fixing point of the part of the thread that is comprised between the tag (E) and the filter bag (B) of the infusion product, once the thread has been fixed and coupled to the tag.

FIGS. 3A and 3C illustrate a first embodiment of the tag (E)-thread (F) assembly, for connecting a filter bag (B) of infusion products of the present invention.

The tags illustrated in these two figures have been represented in two particular embodiments, respectively FIGS. 2*a* and 2L, but the tag (E)-thread (F) assembly proposed by the invention can also be made by using any other possible embodiment of the tag of the invention and illustrated in the various other appended figures.

In these FIGS. 3A and 3C, as previously specified, for the purpose of greater clarity in illustration of the arrangement and passages of the thread (F) through the slits of the tag (E), both faces of the tag (E) of the tag (E)-connecting thread (F) with a filter bag (B) are shown together at the same time.

The tag (E)-connecting thread (F) assembly for a filter bag (B) for infusion products, comprising a thread (F) and a tag (E), as described in the foregoing, the thread (F) exhibiting a coupling end (FA) with a filter bag (B).

The tag (E) is fixed to the thread (F) as the thread (F) is coupled to the tag (E) as follows:

the thread (F), crosses the body (C) of the tag (E) a first time (1) at the first slit (F1), from a first face (E1) to a second face (E2) of the tag (E), leaving a portion (FB) of thread (F) between the first face (E1) and the coupling end (FA) with the filter bag (B), the thread (F) crosses the body (C) of the tag (E) a second time (2) at the second slit (F2), from the second face (E2) to the first face (E1) (in the case of the tag-thread assembly in which the tag is as in the embodiment of FIG. 2L, the thread (F) crosses the body (C) of the tag a second time (2) substantially at the edge between the first straight part ((F21) and the second straight part (F22) of the second slit (F2), see FIG. 3C), and crosses the body (C) of the tag (E) a third time (3) at the third slit (F3), from the first face (E1) to the second face (E2), being superposed on a part of the portion (FB) of thread (F) which from the first face (F1) reaches the coupling end (FA) with the bag (B) (in the case of the tag-thread assembly in which the tag is in the embodiment of FIG. 2L, the thread (F) crosses the body of the tag a third time (3) substantially at the edge between the first straight part (F31) and the second straight part (F32) of the third slit (F3), see FIG. 3C).

In this way the fixing of the tag (E) to the thread (F) is guaranteed, i.e. there is a stable tag (E)-thread (F) assembly in which the thread (F) retains the tag (E) and it exhibits with respect to the tag (E):

a first portion (S1) of thread (F) which remains on the second face (E2) of the tag (E), between the first slit (F1) and the second slit (F2) (first portion (S1) visible with an unbroken line in the figure of the tag to the left in FIGS. 3A and 3C, which represents the second face (E2) of the tag, while it is represented with a broken line in the figure of the tag on the right in FIGS. 3A and 3C, which illustrates the first face (E1) of the tag (E)).

a second portion (S2) of thread (F) which remains on the second face (E1) of the tag (E), from the second slit (F2) to the third slit (F3) superposed and above the part of the portion (FB) of the thread which goes from the first face (E1) of the tag (E) to the coupling end (FA) to the bag (B) (second portion (S2) visible with an unbroken line in the figure of the tag to the left in FIGS. 3A and 3C, which represents the first face (E1) of the tag (E), while it is represented with a broken line in the figure of the tag on the left in FIGS. 3A and 3C, which illustrates the second face (E2) of the tag (E)), and a third portion (S3) terminating in the other free end (FL) of the thread (F).

In particular, the first portion (S1) and the second portion (S2) form a sort of spiral about the portion of tag (E) comprised between the second slit (F2) and the third slit (F3), which spiral starts from the second face (E2) at the first slit (F1) (figure of the tag to the left in FIGS. 3A and 3C), crosses the second slit (F2), is in contact with a part of the first face (E1) comprised between the second slit (F2) and the third slit (F3) (figure of the tag to the left in FIG. 3A an d3C) and crosses the third slit (F3) so as to terminate beyond the first face (E1) of the tag (E).

The spiral of the thread performs a sealing action of the tag (E) to the thread (F); further, the fact that at least one from between the second slit (F2) and the third slit (F3) (preferably both) forms an acute angle between the portion of the side (L) comprised between it and the first slit (F1), i.e. exhibits a divergent progression from a point internally of the body of the tag (E) towards the side (L), prevents the spiral of thread from unthreading from the tag (E).

Further, the fact that the above-mentioned second portion (S2) of thread is superposed on a part of the thread of the portion (FB) of the thread (F) which goes from the first face (E1) of the tag (E) at the first slit F1) to the coupling end (FA) to the bag (B), enables maintaining the part of the thread clamped in the spiral, so as to prevent an unthreading thereof (see for example the figure on the right of FIG. 3A, which represents the first face (E1) of the tag (E)).

In the case of a tag-thread assembly in which the tag is realised according to the embodiment of FIG. 2L (or even FIG. 2I), the thread (F) (the spiral of thread) is positioned so as to cross the second slit (F2) and the third slit (F3) at the edge present between the first straight part and the second straight part, which offers a greater anchoring point with greater resistance to any undesired unthreading.

In further preferred embodiments illustrated in FIGS. 3B and 3D, the tag (E)-connecting thread (F) assembly includes the thread (F) further crossing, for a fourth time (4), the body (C) of the tag (E) with the third portion (S3) newly at the second slit (F2), from the second face (E2) to the first face (E1), so that the third portion (S3) exhibits a first part (S31) (visible with a continuous line in the figure on the left of FIGS. 3B and 3D, and with a broken line in the figure to the right in FIG. 3B) on the second face (E2) of the tag (E), from the third slit (F3) to the second slit (F2), and a second part (S32) projecting from the first face (E1) and terminating in the other free end (FL) of the thread (F).

This enables prolonging, with another thread spiral, winding the spiral about the portion comprised between the second slit (F2) and the third slit (F3) with the aim of further strengthening the fixing and coupling between the tag (E) and the thread (F).

In the case of a tag-thread assembly with a tag realised according to the embodiment of FIG. 2L, as illustrated in FIG. 3D, or FIG. 2I, the further spiral of thread crosses the third slit (F3), again substantially at the edge between the first straight part and the second straight part, increasing the hold thereof against unthreading.

Figures from 4A to 4D illustrate principle steps of the method of the invention, for fastening a tag (E) to a connecting thread (F) to a filter bag (B) for infusion products.

The method includes providing a tag (E) according to the invention, as described above, in one of the various possible embodiments as in figures from 2A to 2L, and supplying a connecting thread (F) with a filter bag (B) having a free end (FL) and a coupling end (FA) with a filter bag (B) (in the figures the coupling end (FA) with a filter bag (B) has been illustrated, purely by way of example, already coupled to a relative bag (B); this does not constitute a limitation to the method of the invention as the thread can be coupled to the bag while it is fixed and coupled to the tag, or can be coupled to the bag at a later time: in substance the steps, and the moment at which the thread is coupled to the bag are not part of the method of the invention).

The method of the present invention includes carrying out following steps:

a) inserting the thread (F) in the first slit (F1) in such a way that via the first slit (F1) it crosses the tag (E) for a first time (1), from a first face (E1) to a second face (E2), and in that a first portion (FT) of the thread (F) terminating in the free end (FL) projects from the second face (E2) and a second portion (FB) of the thread (F) terminating in the coupling end (FA) with the bag (B) projects from the first face (E1) (see FIG. 4A);

b) folding the first portion (FT) of the thread (F) so that it inserts in the second slit (F2) and the thread (F) crosses the tag (E) for a second time (2), from the second face (E2) to the first face (E1), leaving a first portion (S1) of thread (F) in contact with the second face (E2) of the tag (E) between the first slit (F1) and the second slit (F2) (see FIGS. 4B and 4*c*);

c) again folding the first portion (FT) of the thread (F) such that the first portion (FT) first superposes on a part of the second portion (FB) of the thread (F) and pushes said part against the first face (E1) of the tag (E) and in that the first portion (FT) then inserts in the third slit (F3), so that the thread (F) crosses the tag (E) for a third time (3), from the first face (E1) to the second face (E2), leaving a second portion (S2) of thread (F) in contact with the first face (E1) of the tag (E), between the second slit (F2) and the third slit (F3), and superposed on the part of the second portion (FB) of the thread (F) terminating in the coupling end (FA) with the bag (B), and a third portion (S3) projecting beyond the second face (E2) and terminating in the free end (FL) of the thread (F) (see FIG. 4D).

In this way the tag (E)-thread (F) assembly illustrated in FIG. 3A and FIG. 3C is obtained.

In the case of use of a tag according to the embodiments of FIGS. 2I and 2L, the step b) of inserting the thread (F) in the second slit (F2), so that the thread (F) crosses the tag (E) a second time (2) from the second face (E2) to the first face (E1), is done by performing this crossing at the edge between the first straight part ((F21) and the second straight part (F22) of the second slit (F2), while step c) of inserting the thread (F) in the third slit (F3), so that the thread (F) crosses the tag (E) a third time (3), from the first face (E1) to the second face (E2), is done by performing this crossing at the edge between the first straight part (F31) and the second straight part (F32) of the third slit (F3).

Thanks to the three slits thereon, the winding of the thread on the tag can also be repeated for further cycles, with the aim of improving the hold of the reciprocal connection.

In this regard, in particular according to a further advantageous aspect, the method can further comprise, consecutively to carrying out the above-mentioned step c), carrying out a step d) which includes further folding the third portion (S3) of thread (F) projecting from the second face (E2) so that it newly inserts in the second slit (F2), so that the thread (F) crosses the tag (E) a fourth time (4), from the second face (E2) to the first face (E1), so that a first part (S31) of the third portion (S3) remains in contact with the second face (E2) of the tag (E), between the third slit (F3) and the second slit (F2), and a second part (S32) of the third portion (S3) terminating in the free end (FL) of the thread (F), projects from the first face (E1) (see FIG. 4E).

In this way the tag (E)-thread (F) assembly illustrated in FIG. 3B and FIG. 3D is obtained.

The method can advantageously include, before carrying out step a), or entirely equivalently after carrying out step a) but before carrying out step b), a step of increasing a passage space of the thread (F) through the second slit (F2) and the third slit (F3), so as to facilitate passage of the thread (F).

In particular, the step of increasing the passage space of the thread (F) can be done by carrying out a relative movement between the portion of the tag (E) comprised between the second slit (F2) and the third slit (F3) and the parts of the tag (E) adjacent to said portion, and thereafter the method comprises returning the portion of the tag (E) comprised between the second slit (F2) and the third slit (F3) and the parts of the tag (E) adjacent to said portion onto a same plane once step c) or step d) has terminated.

For example, the portion comprised between the second slit (F2) and the third slit (F3) can be folded with respect to the parts of the tag adjacent thereto, or vice versa these adjacent parts can be folded with respect to the portion comprised between the second slit (F2) and the third slit (F3).

Preferably, in a case of use of a tag realised according to the particular embodiment of FIG. 2I or FIG. 2L, the step of increasing the passage space of the thread (F) through the second slit (F2) and the third slit (F3) can be performed by slightly folding the parts of tag (E) comprised, between the second slit (F2) and the second side (L2) of the perimeter edge adjacent thereto and between the third slit (F3) and the third slit (L3) of the perimeter edge adjacent thereto, with respect to the part of the tag (E) comprised between the second (F2) and the third slit (F3) containing the first slit (F1).

In this way, a sufficient manoeuvring space is created for moving the thread and facilitating passage thereof through the second and third slits.

With the method of the invention, no knot at all has been made for fixing the tag to the thread.

The passage of the thread through the slits of the tag can be done using a handling organ able to retain and move the thread.

The invention claimed is:

1. A tag to be fixed to a connecting thread with a filter bag for infusion products, comprising a flat body delimited by a perimeter encircling a polygonal shape, the perimeter comprising at least a straight side extending along a straight line, the tag comprising:

a first slit which extends from a first starting point on the straight side of the perimeter along a first line and ends within the flat body;

a second slit and a third slit respectively extending from a second starting point and a third starting point on the straight side of the perimeter, the second slit and the third slit respectively extending along a second line and a third line, the first starting point being disposed between said second starting point and said third starting point on said straight side, at least one of the second line and the third line has a starting portion respectively extending from the second starting point or the third starting point, which is inclined with respect to said straight side, at least one of the second line and the third line passes through a point located, within the perimeter of the flat body, on a main straight line extending from the first starting point perpendicularly to the straight side;

the first slit, the second slit and the third slit not intersecting each other, the first slit, the second slit and the third slit being configured to enable passage there-through of the connecting thread for fixing the tag to the thread.

2. The tag of claim 1, wherein the second line along which extends the second slit comprises a first straight part which exhibits a direction directed towards and converging towards a point of the part of the main straight line comprised in the plane of the flat body of the tag and perpendicular to the straight side at the first starting point of the first slit, and a second straight part consecutive and continuous to the first straight part which instead exhibits a direction directed towards a second side of the perimeter of the tag, the first straight part and the second straight part of the second line forming an edge and forming between them an acute angle or at most a right angle, and in that the third line along which extends the third slit comprises a first straight part exhibiting a direction directed and converging towards a point of the part of the main straight line comprised in the plane of the flat body of the tag and perpendicular to the straight side at the first starting point of the first slit, and a second straight part consecutive and continuous to the first straight part which instead exhibits a direction directed towards a third side of the perimeter of the tag, the first straight part and the second straight part of the third line forming an edge and forming between them an acute angle or at most a right-angle.

3. The tag of claim 2, wherein the first straight part of the second line along which extends the second slit and the first straight part of the third line along which extends the third slit exhibit directions such that a prolongation thereof is such as to intersect the part of the main straight line comprised in the plane of the flat body of the tag, and perpendicular to the straight side at the first starting point of the first slit, in a same corresponding point, the first straight part of the second line and the first straight part of the third line exhibiting a same inclination with respect to the straight side of the perimeter of the flat body.

4. The tag of claim 2, wherein the second straight part of the second line along which extends the second slit and the second straight part of the third line along which extends the third slit exhibit directions such as to form, with the relative first straight parts, an angle of a same value.

5. The tag of claim 2, wherein the relative flat body exhibits a form such as to have at least an axis of symmetry and in that the first starting point of the first slit on the straight side of the perimeter is arranged at the axis of symmetry, the first line along which extends the first slit being a straight line arranged at the axis of symmetry, and in that the first straight part of the second line along which extends the second slit and the first straight part of the third line along which extends the third slit exhibit directions such that the prolongation thereof is such as to intersect the first straight line at a common point.

6. The tag of claim 2, further comprising, at the first starting point of the first slit, a first semi-circular cut, and at the point of the opposite side to the side situated on the axis of symmetry, a second semi-circular cut.

7. The tag of claim 5, further comprising, on the side of the perimeter opposite the straight side from which the first, second and third slit extend, a fourth straight slit arranged at the axis of symmetry.

8. The tag of claim 1, wherein the flat body exhibits a shape that is such as to have at least an axis of symmetry and in that the first starting point of the first slit on the straight side of the perimeter is arranged at the axis of symmetry, and at least one of the second line and the third line along which extends respectively the second and third slits converges towards a point of said at least an axis of symmetry and comprised in the flat body of the tag.

9. The tag of claim 8, wherein both the second line and the third line along which extends respectively the second and third slits converges towards a point of said at least an axis of symmetry and comprised in the flat body of the tag.

10. The tag of claim 8, wherein at least one of the second line and the third line along which extends respectively the second and third slits exhibits a straight or curved development.

11. The tag of claim 8, wherein the first line along which extends the first slit exhibits a straight development perpendicular to the straight side of the perimeter either inclined with respect to said straight side, or a curved development, or exhibits a development having one of following shapes: a T, L or S shape.

12. The tag of claim 8, wherein the extension of the first line along which extends the first slit is smaller than the extension of the second line and the third line along which extends respectively the second and third slits.

13. The tag of claim 8, wherein the first line along which extends the first slit, the second line along which extends the second slit and the third line along which extends the third slit exhibit a straight development, the extension of the first line being at least equal, in particular larger, than the extension of the second line and the third line, and in that both the second line and the third line exhibit an inclination with respect to the straight side that is such that both exhibit a converging direction towards the final end point of the first line.

14. A tag-connecting thread assembly for a filter bag for infusion products, comprising a thread and a tag, the thread exhibiting a coupling end with a filter bag, comprising:

a tag according to claim 1, and in that the tag is fixed to the thread as the thread is coupled to the tag as follows:

by crossing the flat body of the tag a first time at the first slit, from a first face to a second face of the flat body of the tag, leaving a portion of thread between the first face and the coupling end with the filter bag, by crossing the flat body of the tag a second time at the second slit, from the second face to the first face, and by crossing the flat body of the tag a third time at the third slit, from the first face to the second face, being superposed on a part of the portion of thread which from the first face reaches the coupling end with the bag, so that the thread retains the tag as the thread exhibits, with respect to the tag, a first portion of thread which remains on the second face of the flat body of the tag, between the first slit and the second slit, a second portion of thread which remains on the first face of the flat body of the tag, from the second slit to the third slit, superposed and above the part of the portion of the thread which from the first face of the flat body of the tag reaches the coupling end to the bag, and a third portion terminating in the other free end of the thread.

15. The tag-connecting thread assembly of claim 14, wherein the thread further crosses, for a fourth time, the flat body of the tag with the third portion at the second slit, from the second face to the first face, so that the third portion exhibits a first part on the second face of the flat body of the tag, from the third slit to the second slit, and a second part projecting from the first face and terminating in the other free end of the thread.

16. A tag to be fixed to a filter bag for infusion products via a connecting thread, comprising a flat polygonal body having an outer perimeter with a plurality of linear or straight edges contiguous one to the other, said polygonal body being formed with a first slit, a second slit and a third slit each having an open end and a closed end opposite thereto and each having an open end portion including the respective open end, each of said first slit, a second slit and a third slit extending to a common one of said linear or straight edges so that said first slit, said second slit and said third slit intersect, at the respective open ends, with said common one of said linear or straight edges, the open end portions of said second slit and said third slit being located on opposite sides of the open end portion of said first slit, the open end portion of at least one of said second slit and said third slit being inclined from said common one of said linear or straight edges towards the open end portion of said first slit, said first slit, said second slit and said third slit being configured to enable passage there-through of the connecting thread, for fixing the tag to the thread.

* * * * *